US006669247B2

(12) United States Patent
Swan

(10) Patent No.: US 6,669,247 B2
(45) Date of Patent: Dec. 30, 2003

(54) VEHICLE DOOR LATCH DEVICE

(75) Inventor: Oliver Swan, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/950,417

(22) Filed: Sep. 11, 2001

(65) Prior Publication Data

US 2002/0030366 A1 Mar. 14, 2002

(30) Foreign Application Priority Data

Sep. 11, 2000 (JP) ..... 2000-274404

(51) Int. Cl.[7] ..... E05C 3/06

(52) U.S. Cl. ..... 292/201; 292/201; 292/216; 292/DIG. 23

(58) Field of Search ..... 292/201, 216, 292/DIG. 23

(56) References Cited

U.S. PATENT DOCUMENTS

| | | | | |
|---|---|---|---|---|
| 4,395,064 A | | 7/1983 | Bellot et al. | |
| 4,927,204 A | | 5/1990 | Asada | |
| 5,172,946 A | | 12/1992 | Dowling | |
| 5,667,260 A | * | 9/1997 | Weyerstall | 292/201 |
| 5,868,444 A | | 2/1999 | Brackmann et al. | |
| 6,048,002 A | | 4/2000 | Ohta et al. | |
| 6,079,237 A | * | 6/2000 | Hochart | 292/201 |
| 6,131,337 A | * | 10/2000 | Machida | 292/201 |
| 6,131,967 A | | 10/2000 | Kondo et al. | |
| 6,145,354 A | | 11/2000 | Kondo et al. | |
| 6,223,468 B1 | * | 5/2001 | Kobayashi | 292/201 |
| 6,328,354 B1 | * | 12/2001 | Dejean et al. | 292/116 |
| 6,409,233 B1 | * | 6/2002 | Hanaki | 292/144 |
| 2001/0005079 A1 | | 6/2001 | Takamura | |
| 2001/0010427 A1 | | 8/2001 | Roos | |

* cited by examiner

*Primary Examiner*—J. J. Swann
*Assistant Examiner*—Thomas Ho
(74) *Attorney, Agent, or Firm*—Browdy and Neimark, P.L.L.C.

(57) ABSTRACT

A vehicle door latch device comprises a latch engageable with a striker and rotatable from an unlatched position to a full-latched position via a half-latched position, a power closing mechanism rotating the latch from the half-latched position to the full-latched position by motor power, a ratchet holding an engagement state between the latch and the striker by engaging with the latch, and a power opening mechanism releasing the ratchet from the latch by motor power. The power opening mechanism and the power closing mechanism are actuated by a single common motor, respectively.

2 Claims, 4 Drawing Sheets

10
9
11
12
15
14
5
21A
22
36
32
13
31
9
20
27
30
40
23
1
29
3
8
33
34
2
4
6
7
8A

VEHICLE DOOR LATCH DEVICE

BACKGROUND OF THE INVENTION

1. Field of the Invention

The present invention relates to a vehicle door latch device, and in particular to a latch device provided with power closing and power opening mechanisms of a door (including a hinged passenger door, a trunk lid, a glass hitch, a tailgate and the like).

2. Description of the Related Art

Conventionally, a door latch device provided with both a power closing mechanism and a power opening mechanism has been known. The known power closing mechanism causes a latch to be rotated to a full-latched position by a motor power after the latch is rotated to a half-latched position through engagement with a striker so that a door is displaced from a half-latched state to a full-latched state. Also, the known power opening mechanism causes the latch to be free to rotate by releasing a ratchet from the latch with a motor power.

A problem in such a conventional door latch device lies in that each of the power closing and the power opening mechanisms has own motor. Using two motors causes increase in cost of the latch device and increase in weight thereof.

Further, the vehicle door latch device provided with the power closing mechanism is conventionally provided with a safety mechanism which stops or invalidates operation of the power closing mechanism. The safety mechanism is provided with a function for releasing a connected state between the latch and the motor and a function for releasing the ratchet from the latch.

There is a drawback that the conventional safety mechanism is complicated and is increased in the number of parts.

SUMMARY OF THE INVENTION

In view of the above circumstances, an object of the present invention is to provide a door latch device where a power closing mechanism and a power opening mechanism can be operated by only one common motor. Since the power closing mechanism and the power opening mechanism shares one common motor, the door latch device of the present invention can be manufactured inexpensively in a small size and in a reduced weight.

Also, another object of the present invention is to provide a door latch device with a simplified structure, which stops or invalidates operation of a power closing mechanism.

DETAILED DESCRIPTION OF THE PREFERRED EMBODIMENT

Figure 1:
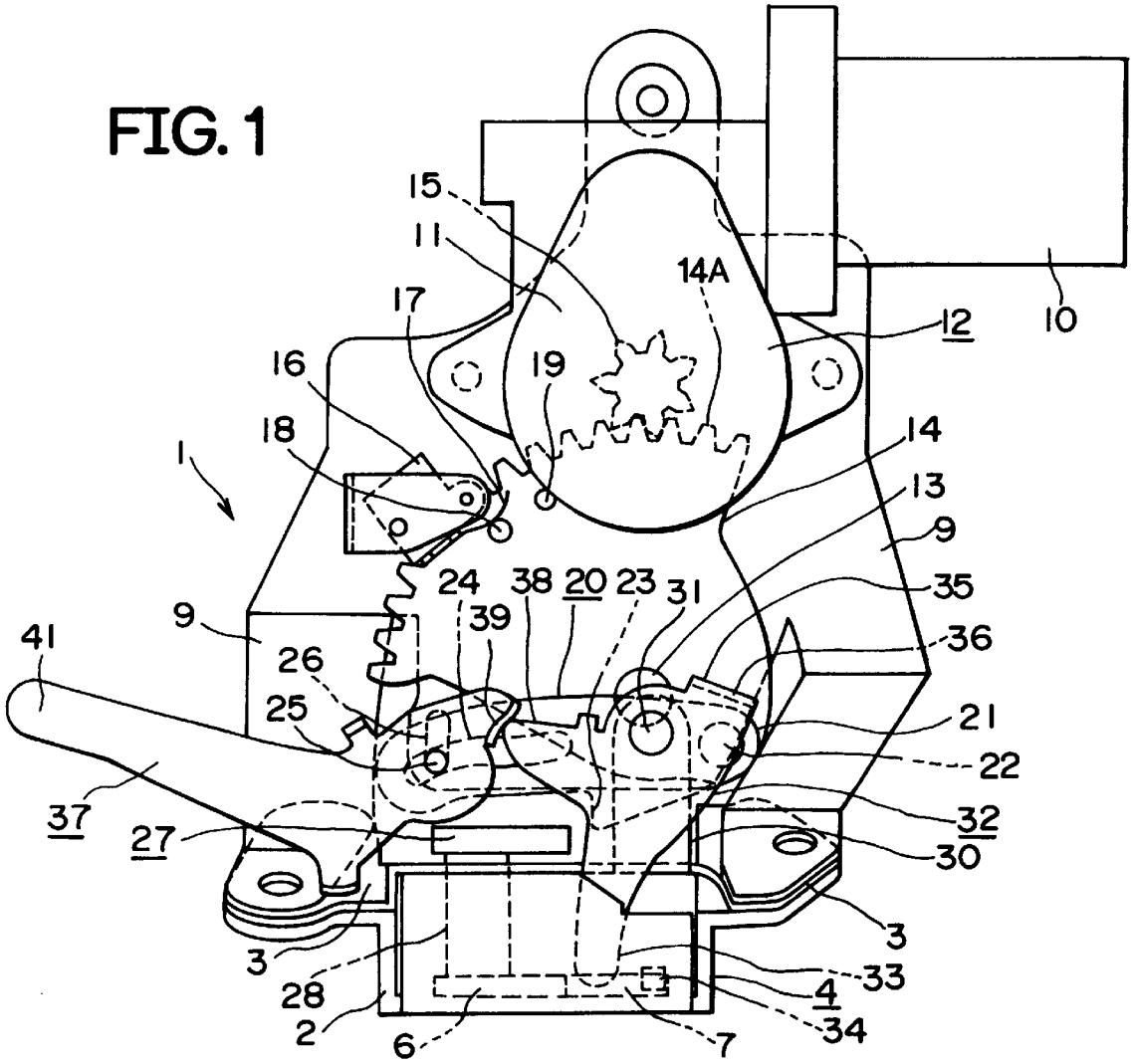
FIG. 1 is a front view of a door latch device according to the present invention.
Figure 2:
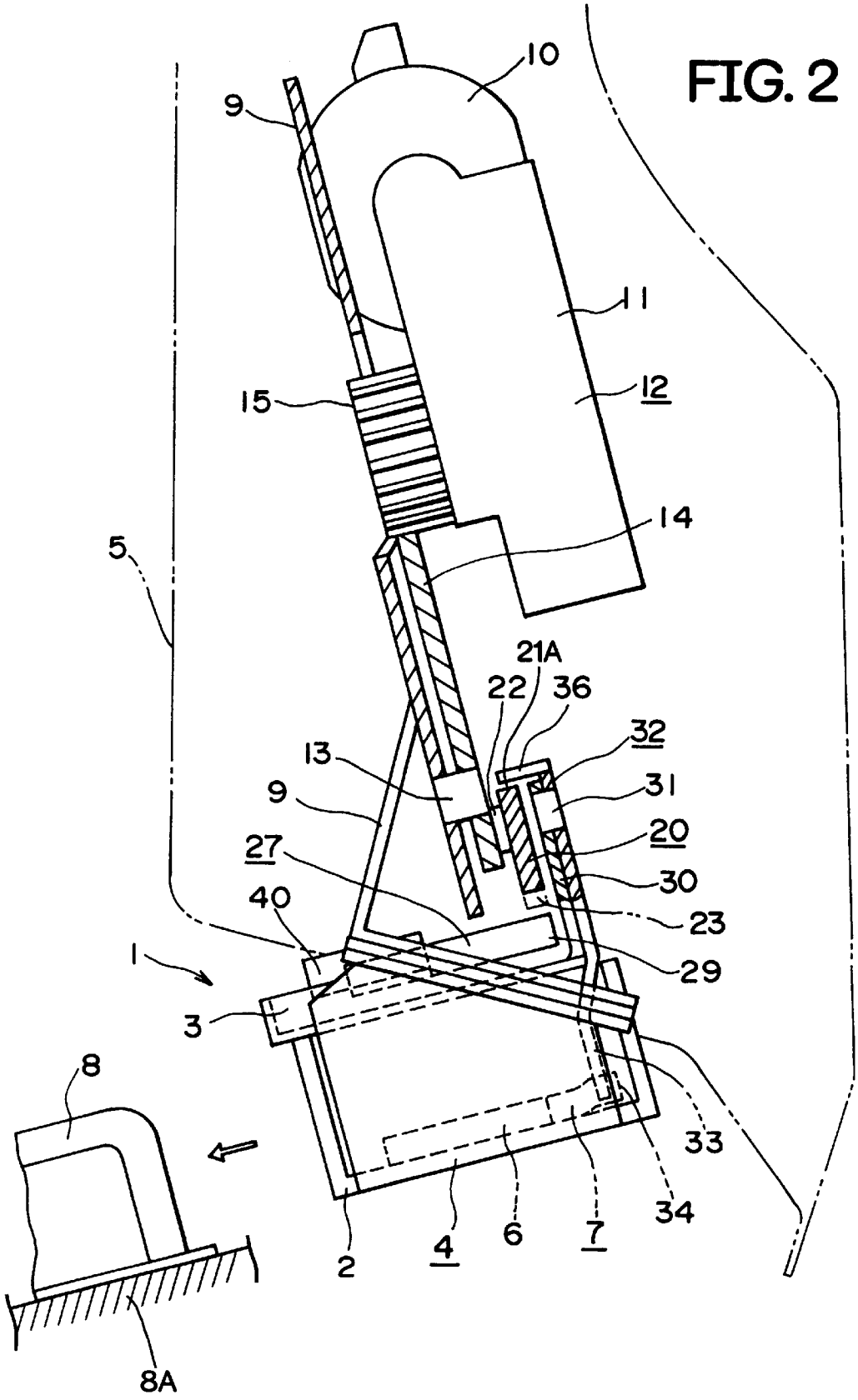
FIG. 2 is a vertically sectional side view of the door latch device.

An embodiment of the present invention will be explained with reference to the drawings. A door latch device 1 according to the present invention is provided with a latch body 4 comprising a base plate 2 and a cover plate 3, such as that shown in U.S. Pat. No. 5,172,946. The door latch device 1 is mounted to a vehicle door (including a hinged passenger door, a trunk lid, a glass hatch, tailgate and the like). The device 1 shown in FIGS. 1 and 2 is particularly suitable for mounting on a tailgate 5.

Well-known latch 6 and ratchet 7 are rotatably accommodated inside the latch body 4. When moving the tailgate 5 in a door closing direction, the latch 6 is brought into contact with a striker 8 fixed to a vehicle body 8*a* and is rotated from an unlatched position to a half-latched position to be engaged with the striker 8 initially. The latch 6 is rotated from the half-latched position to a full latched position to be fully engaged with the striker 8 due to further movement of the tailgate 5. The ratchet 7 is engaged with the latch 6 so as to keep engagement between the latch 6 and the striker 8.

An upwardly projecting bracket 9 is fixed to the latch body 4, and a motor unit 12 comprising a motor 10 and a reduction gear mechanism 11 is mounted to an upper portion of the bracket 9. A sector gear 14 is pivoted to a central portion of the bracket 9 through a sector shaft 13, and a gear portion 14A of the sector gear 14 meshes with an output gear 15 of the motor unit 12. The sector gear 14 being in a neutral position shown in FIG. 1 is rotatable in a clockwise direction (door closing direction) and in a counterclockwise direction (door opening direction) by power of the motor 10. A sector switch 16 is provided on the bracket 9 in the vicinity of the sector gear 14. When the sector gear 14 is rotated, a contact terminal 17 of the sector switch 16 is selectively brought into contact with one of two sensor pins 18 and 19.

Figure 3:
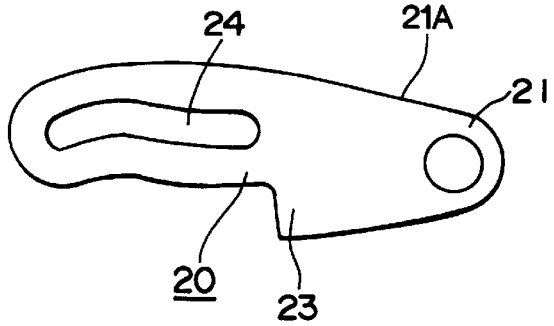
FIG. 3 is a front view of a pushing link of the door latch device.

A right end portion 21 of a pushing link 20 (FIG. 3) is pivoted to a proximal portion side of the sector gear 14 via a pin 22. The substantially horizontally elongated pushing link 20 is provided at its central lower portion with an vertically extending abutting portion 23 and it is also provided at its left side portion with a substantially horizontally elongated gently curved guide slot 24. A front end portion of a guide pin 25 extending in a front-and-rear direction is slidably inserted into the guide slot 24. When the sector gear 14 is rotated from the neutral position in the clockwise direction, the pushing link 20 is moved to a left side while its left side portion is being guided by the guide pin 25. A rear end portion of the guide pin 25 is inserted into a vertical groove or slot 26 formed in the bracket 9. The pin 25 is slidable in a vertical direction within the vertical groove 26.

A latch lever 27 provided above the latch body 4 is rotated together with the latch 6 as one piece. The latch 6 and the latch lever 27 have a common rotating shaft or latch shaft 28. A latch switch 40 is disposed in the vicinity of the latch lever 27. By contact of the latch switch 40 with the latch lever 27, the half-latched position of the latch 6 is detected.

A front end 29 of the latch lever 27 is positioned in the vicinity of the abutting portion 23 of the pushing link 20. When the pushing link 20 is moved leftward by power of the motor 10, the abutting portion 23 abuts on the front end 29 of the latch lever 27 to rotate the latch 6 toward the full-latched position via the latch lever 27. The mechanism for rotating the latch lever 27 (latch 6) by the motor power of the motor 10 is called "power closing mechanism". The power closing mechanism is actuated when the latch switch 40 detects the half-latched position of the latch 6.

The cover plate 3 of the latch body 4 has an upwardly extending sub-plate 30, and a ratchet lever 32 is pivoted to the sub-plate 30 via a shaft 31. A first arm 33 of the ratchet lever 32 extends inside the latch body 4 through a gap between the base plate 2 and the cover plate 3 so as to be engageable with a distal end 34 of the ratchet 7.

A short second arm 35 of the ratchet lever 32 has a rearward bent portion 36 which is engageable with an upper face 21A of the right end portion 21 of the pushing link 20. When the sector gear 14 is rotated from the neutral position in the counterclockwise direction by power of the motor 10, the upper face 21A of the right end portion 21 abuts on the bent portion 36 to rotate the ratchet lever 32 about the shaft 31 in the counterclockwise direction. The first arm 33 of the ratchet lever 32 then abuts on the distal end 34 of the ratchet 7 to rotate the ratchet 7, thereby the ratchet 7 is released from the latch 6 and the tailgate 5 is opened. The mechanism for rotating the ratchet 7 by the motor power of the motor 10 is called "power opening mechanism". It should be noted that the power opening mechanism and the power closing mechanism has only one common motor 10.

An opening lever 37 is disposed on a left side of the ratchet lever 32. The opening lever 37 is rotatably supported at a front end of the guide pin 25. The opening lever 37 is provided at its right end with a pushing portion 39 which is engageable with a third arm 38 of the ratchet lever 32. It is desirable that an operation arm 41 of the opening lever 37 is connected to a key cylinder (not shown) of the tailgate 5.

Operation of the door latch device of the present invention will be explained below.

When the tailgate 5 is manually moved in the closing direction, the latch 6 is rotated from the unlatched position to the half-latched position due to the initial engagement with the striker 8, and the latch switch 40 then detects displacement of the latch 6 to the half-latched position. Simultaneously, the ratchet 7 is engaged with the latch 6 to keep the initial engagement of the latch 6 and the striker 8.

When the initial engagement (half-latched state) is detected, the power closing mechanism is actuated. That is, the motor 10 that is a member of the power closing mechanism rotates in the closing direction to rotate the sector gear 14 in the clockwise direction in FIG. 1. Then, the pushing link 20 connected to the sector gear 14 via the pin 22 is moved leftward, and the abutting portion 23 of the pushing link 20 is brought into contact with the front end 29 of the latch lever 27 to rotate the latch lever 27 as shown in FIG. 4, thereby the latch 6 is rotated from the half-latched position to the full-latched position via the latch lever 27 and the tailgate 5 is closed by power of the motor 10.

The rotation of the motor 10 in the closing direction is controlled by time, a load current value of the motor 10 or the like. When the latch 6 is displaced into the full-latched position by the motor 10, the motor 10 is rotated in the opening direction until the contacting terminal 17 of the sector switch 16 comes in contact with the sensor pin 18 of the sector gear 14, and the sector gear 14 is returned to the neutral position.

Figure 4:
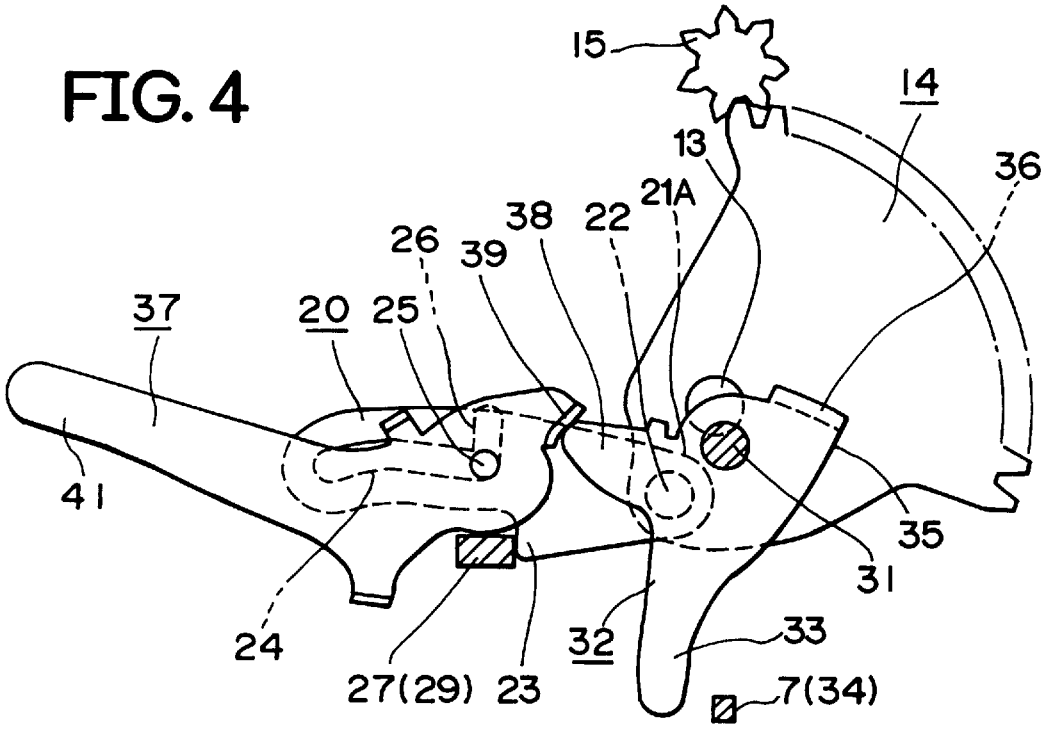
FIG. 4 is a front view showing a state where a sector gear of the door latch device has been rotated in a door closing direction.
Figure 5:
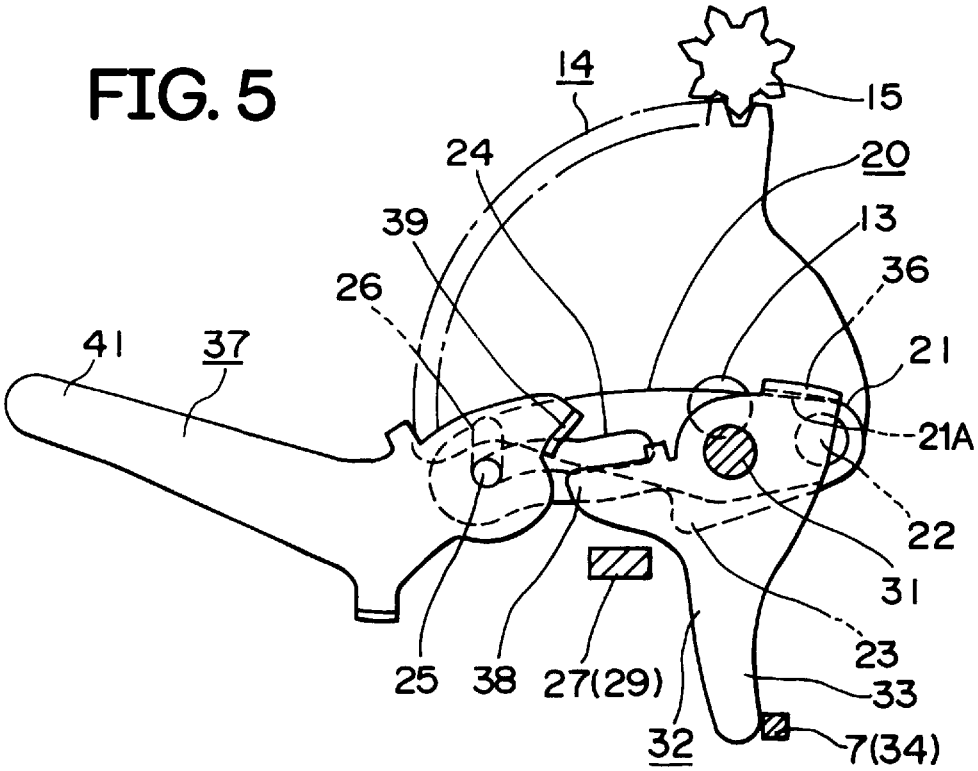
FIG. 5 is a front view showing a state where the sector gear has been rotated in a door opening direction.
Figure 6:
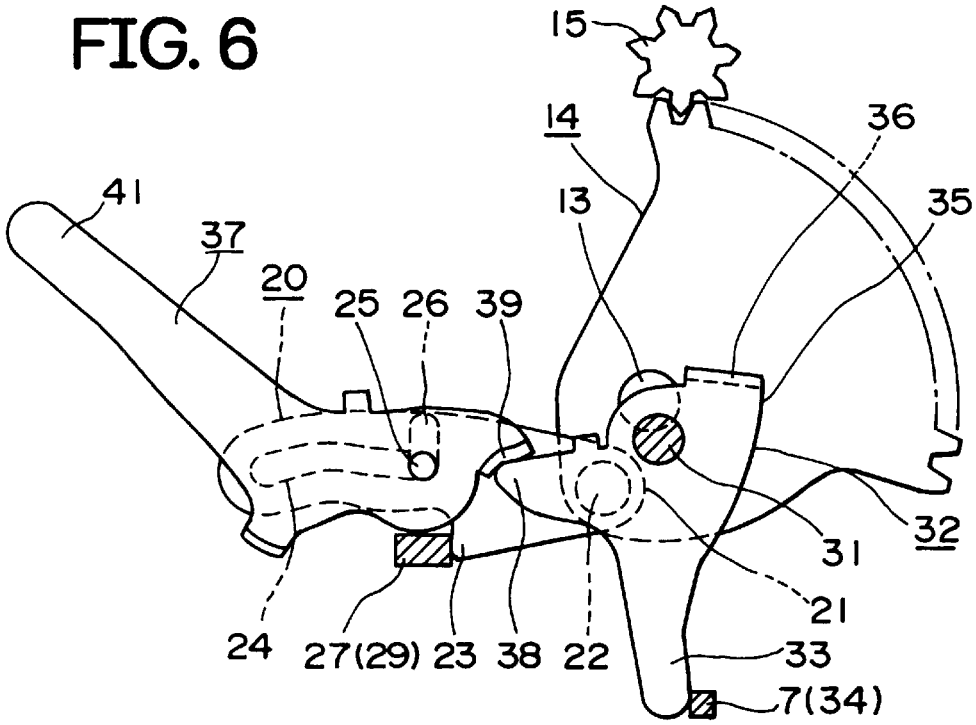
FIG. 6 is a front view showing a state where an opening lever of the door latch device has been rotated with a first operating force.

In order to conduct emergent stopping of the closing operation of the tailgate 5 effected by the power of the motor 10, the operation arm 41 of the opening lever 37 is moved upward in FIG. 4. Then, the opening lever 37 is rotated about the guide pin 25 in the clockwise direction and the pushing portion 39 of the opening lever 37 pushes the third arm 38 of the ratchet lever 32 downward so as to rotate the ratchet lever 32 about the shaft 31 in the counterclockwise direction, as shown in FIG. 6, thereby the first arm 33 of the ratchet lever 32 abuts on the distal end 34 of the ratchet 7 to rotate the ratchet 7, so that the latch 6 is released from the ratchet 7. The force or power applied for rotating the opening lever 37 about the guide pin 25 in the clockwise direction by moving the operating lever 4 upward is hereinafter referred to as "first operating force".

In the state shown in FIG. 6, the latch 6 is put in a state where it has been released from the restraint of the ratchet lever 7. However, the abutting state of the abutting portion 23 of the pushing link 20 and the latch lever 27 is still maintained, and this means that the connection between the latch 6 and the motor 10 has not been released yet. Therefore, the latch 6 cannot return back towards the unlatched position in the state shown in FIG. 6.

Figure 7:
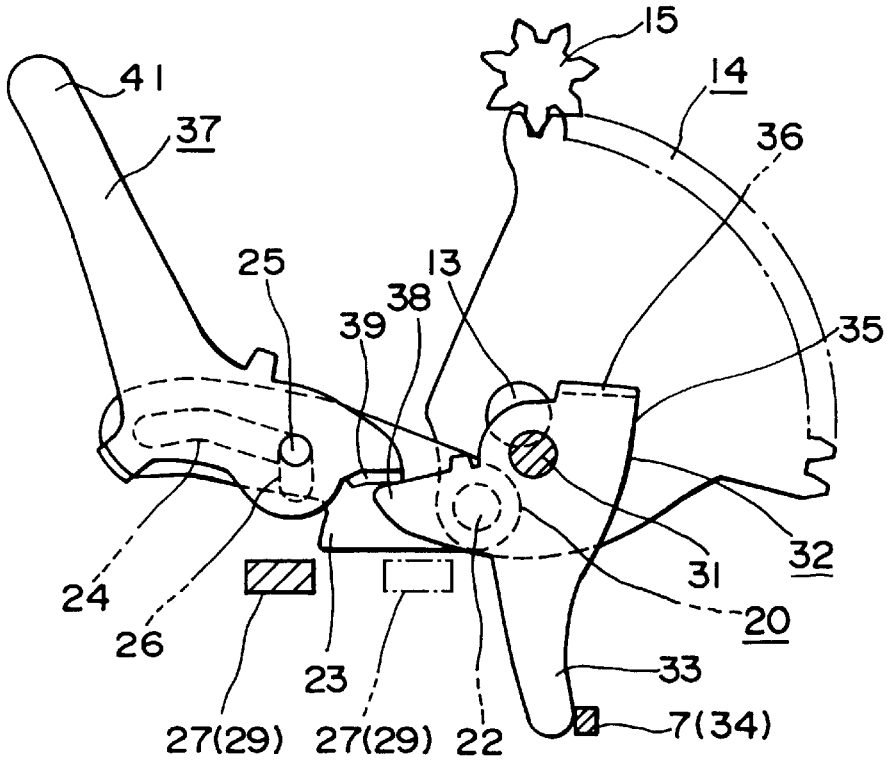
FIG. 7 is a front view showing a state where the opening lever has been moved with a second operation force.

For this reason, in the state shown in FIG. 6, the operating arm 41 of the opening lever 37 is further lifted by a second operating force in order to cancel the connection state between the latch 6 and the motor 10. That is, when applying the second operating force to the opening lever 37, the opening lever 37 is moved upward using the third arm 38 of the ratchet lever 32 as a fulcrum, as the ratchet lever 32 is positioned at a mechanical rotation limit position. The guide pin 25 is then moved upwardly along the vertical groove 26 and the pushing link 20 is rotated about the pin 22 in the clockwise direction as shown in FIG. 7, thereby the abutting portion 23 of the pushing link 20 is disengaged from the front end 29 of the latch lever 27, so that the connection state of the latch 6 and the motor 10 is cancelled. As a result, the front end 29 of the latch lever 27 returns back from the solid line position to an imaginary line position (unlatched position) and the tailgate 5 is opened. Since the second operating force acts in the substantially same direction as the first operating force, an operator must not distinguish the first operating force and the second operating force from each other. Therefore, when he/she lifts up the operating arm 41 simply, the first operating force and the second operating force serve necessarily in a sequential manner.

In the closed state of the tailgate, when the motor 10 is rotated in the opening direction by a door opening switch of a remote controller or an actuation switch provided near to a driver's seat, the sector gear 14 is rotated from the neutral position in the counterclockwise direction, the right end portion 21 of the pushing link 20 is then moved upward to abut on the bent portion 36 of the ratchet lever 32, and the ratchet lever 32 is rotated about the shaft 31 in the counterclockwise direction. Then, the first arm 33 is brought into contact with the distal end 34 of the ratchet 7 to rotate the ratchet 7, so that the latch 6 is released from the ratchet 7 and the tailgate 5 is opened.

In the above embodiment, the present invention has been explained as the latch device for the tailgate, but the power closing mechanism and the power opening mechanism are also applicable to various latch device for a vehicle door including a swinging type door and a sliding type door. When these doors is each provided with an opening handle, such a structure may be employed that the opening lever 37 is connected to the opening handle.

What is claimed is:

1. A vehicle door latch device comprising:

a latch engageable with a striker and rotatable from an unlatched position to a full-latched position via a half-latched position;

a ratchet holding an engagement state between the latch and the striker by engaging with the latch; and a ratchet lever releasing the ratchet from the latch when rotated;

an opening lever rotating the ratchet lever; and a power closing mechanism rotating the latch from the half-latched position to the full-latched position by motor power, said power closing mechanism being provided with a pushing link which rotates the latch from the half-latched position to the full-latched position by engaging with the latch when moved by the motor power;

wherein said opening lever is provided with a function of cancelling the engagement between the latch and the pushing link in addition to a function of rotating the ratchet lever;

wherein said opening lever rotates the ratchet lever by a first operating force and cancels the engagement between the latch and the pushing link by a second operating force following the first operating force; and wherein said opening lever is rotatably supported to a guide pin which is slidably mounted to a first slot formed in a fixed bracket of the door latch device, and the opening lever is rotated about the guide pin by the first operating force and cause the guide pin to slide within the first slot by the second operating force.

2. A vehicle door latch device according to claim 1, wherein said pushing link is provided with a second slot with which the guide pin is slidably engaged, and the pushing link is displaced in a non-engaging position where the pushing link is not engageable with the latch by sliding movement of the guide pin within the first slot.

* * * * *